US008123529B2

(12) United States Patent
Beaman

(10) Patent No.: US 8,123,529 B2
(45) Date of Patent: Feb. 28, 2012

(54) APPARATUS FOR CONNECTING TWO AREA ARRAY DEVICES USING A PRINTED CIRCUIT BOARD WITH HOLES WITH CONDUCTORS ELECTRICALLY CONNECTED TO EACH OTHER

(75) Inventor: Brian S. Beaman, Research Triangle Park, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/642,066

(22) Filed: Dec. 18, 2009

(65) Prior Publication Data

US 2011/0151688 A1 Jun. 23, 2011

(51) Int. Cl.
*H01R 12/00* (2006.01)

(52) U.S. Cl. ..... 439/66

(58) Field of Classification Search ..... 439/66, 439/71, 79, 219, 751

See application file for complete search history.

(56) References Cited

U.S. PATENT DOCUMENTS 4,538,878 A * 9/1985 Dambach et al. ..... 439/742

(Continued)

FOREIGN PATENT DOCUMENTS

EP 1087467 A2 3/2001

OTHER PUBLICATIONS

J. S. Corbin et al. "Land grid array sockets for server applications", IBM Journal of Research and Development, vol. 46 ,Issue 6 (Nov. 2002), pp. 763-778.

(Continued)

*Primary Examiner* — Chandrika Prasad

(74) *Attorney, Agent, or Firm* — Kunzler Needman Massey & Thorpe

(57) ABSTRACT

An apparatus, system, and method are disclosed for providing electrical connections for an area array device. Each of a plurality of holes in a circuit board has a conductor within it and has an opening on a side of the circuit board. Electrically conductive contact posts extend from the openings of the holes. The contact posts are in a pattern corresponding to contact pads on an area array device. A compliant portion of each contact post is inserted within a hole. The conductor compresses the compliant portion to removably secure the contact post within the hole. The conductors form an electrical connection with the contact post. A spring portion of each contact post extends away from the circuit board. The spring portion is compressible toward the circuit board, and provides an electrical connection between a contact post and a contact pad in response to contact with the contact pad.

22 Claims, 10 Drawing Sheets

U.S. PATENT DOCUMENTS

| | | | | |
|---|---|---|---|---|
| 4,541,034 | A * | 9/1985 | Fanning | 361/773 |
| 4,857,018 | A * | 8/1989 | Pickles | 439/751 |
| 5,452,512 | A | 9/1995 | Foley et al. | |
| 6,106,308 | A * | 8/2000 | Chen et al. | 439/79 |
| 6,186,797 | B1 | 2/2001 | Wang et al. | |
| 6,733,303 | B2 * | 5/2004 | Maldonado et al. | 439/66 |
| 6,974,915 | B2 | 12/2005 | Brodsky et al. | |
| 7,025,600 | B2 | 4/2006 | Higashi | |
| 7,044,746 | B2 | 5/2006 | Copper et al. | |
| 7,074,048 | B2 | 7/2006 | Liao et al. | |
| 7,114,960 | B2 | 10/2006 | Rathburn | |
| 7,122,905 | B2 | 10/2006 | Grigg | |
| 7,131,875 | B2 | 11/2006 | Kodaira et al. | |
| 7,189,080 | B2 | 3/2007 | Tang et al. | |
| 7,261,572 | B2 | 8/2007 | Zheng | |
| 7,467,949 | B2 | 12/2008 | Liao | |
| 7,473,104 | B1 | 1/2009 | Wertz | |
| 7,503,811 | B2 | 3/2009 | Seo et al. | |
| 2004/0002234 | A1 | 1/2004 | Masao et al. | |
| 2004/0259394 | A1 * | 12/2004 | Chiang | 439/66 |
| 2005/0227511 | A1 * | 10/2005 | Sun et al. | 439/66 |
| 2006/0121750 | A1 * | 6/2006 | Beurskens | 439/66 |
| 2006/0166479 | A1 | 7/2006 | Seo et al. | |
| 2009/0070999 | A1 | 3/2009 | Hougham et al. | |

OTHER PUBLICATIONS

D. D. Brown et al, "An adaptable, high performance LGA connector technology", 52nd Electronic Components and Technology Conference, 2002. Proceedings, May 28-31, 2002, pp. 17.

PCT/EP2010/067128, International Search Report and Written Opinion, Jan. 19, 2011.

AUS920090228US2 Office Action, U.S. Appl. No. 13/005,465, Mar. 15, 2011.

* cited by examiner

APPARATUS FOR CONNECTING TWO AREA ARRAY DEVICES USING A PRINTED CIRCUIT BOARD WITH HOLES WITH CONDUCTORS ELECTRICALLY CONNECTED TO EACH OTHER

BACKGROUND

1. Field of the Invention

This invention relates to electrical connections and more particularly relates to electrical connections for an area array device.

2. Description of the Related Art

An area array device has an array of electrical contact pads on a face of the device, instead of having pins or other contacts around a perimeter of the device. An array of contact pads provides far more connections than do contacts around a perimeter. Area array devices also have heat conduction and electrical performance advantages. Area array devices can be electrically connected by using a socket, or by directly soldering the contact pads to form connections.

Area array sockets, however, typically do not provide integral connections between contacts within the socket or to other auxiliary electrical devices. Instead, area array sockets usually connect the area array device contact pads directly, linearly, to a circuit board, another area array device, or the like. For example, one type of area array socket uses a molded plastic housing with electrically conductive contacts stitched or staked through the housing. This type of socket doesn't allow for internal connections within the socket, but simply makes a one-to-one connection straight through the socket using the contacts. Strict one-to-one connections limit the configurability and the functionality of an area array socket and hinder integration with other electronic components.

Because the connections in traditional sockets are direct, one-to-one connections, they also typically cause wiring congestion around the socket, especially with high contact count area array devices. Additionally, area array sockets are often difficult to repair or reconfigure. The socket's contacts are often permanently attached to the socket, making repair or reconfiguration of the socket difficult or impossible. In such a configuration, individual contacts usually cannot be repositioned or replaced without replacing the entire socket.

BRIEF SUMMARY

From the foregoing discussion, it should be apparent that a need exists for an apparatus, system, and method that provide integral electrical connections within an area array socket. Beneficially, such an apparatus, system, and method would relieve wiring congestion around the socket, and would be repairable and reconfigurable.

The present invention has been developed in response to the present state of the art, and in particular, in response to the problems and needs in the art that have not yet been fully solved by currently available electrical connections for an area array device. Accordingly, the present invention has been developed to provide an apparatus, system, and method for providing electrical connections for an area array device that overcome many or all of the above-discussed shortcomings in the art.

The apparatus to provide electrical connections for an area array device is provided with a plurality of elements. These elements in the described embodiments include a plurality of holes, a plurality of electrically conductive contact posts, a compliant portion of each contact post, and a spring portion of each contact post. In a further embodiment, the elements include a second plurality of electrically conductive contact posts, one or more circuit traces, one or more electrical devices, an electrical connector, a seating portion of each contact post, a housing, and a press device.

In one embodiment, the plurality of holes is disposed within a circuit board. In a further embodiment, each hole comprises a conductor within the hole and an opening on a side of the circuit board. In one embodiment, the plurality of contact posts extends from the openings of at least a portion of the plurality of holes. The plurality of contact posts, in another embodiment, is disposed in a pattern corresponding to contact pads on an area array device.

In one embodiment, the compliant portion of each contact post is inserted within one of the plurality of holes. The conductor within the hole, in a further embodiment, compresses the compliant portion to removably secure the contact post within the hole and to provide an electrical connection between the contact post and the conductor within the hole.

In one embodiment, the compliant portion comprises an eye of the needle compliant pin section.

The spring portion of each contact post, in one embodiment, extends away from the circuit board. In a further embodiment, the spring portion is compressible toward the circuit board in response to contact with a contact pad of the area array device. In another embodiment, the spring portion provides an electrical connection between the contact post and the contact pad in response to the contact with the contact pad. In one embodiment, the spring portion is selected from the group consisting of a cantilever beam, a radial spring, a fuzz button, and a C spring.

In one embodiment, the second plurality of electrically conductive contact posts extends from opposite openings of at least a portion of the plurality of holes. The opposite openings, in one embodiment, are disposed in an opposite side of the circuit board. The conductors within the holes, in a further embodiment, extend between the openings and the opposite openings. In one embodiment, the second plurality of contact posts is disposed in a pattern corresponding to contact pads on a second area array device and the circuit board comprises an interposer between the area array device and the second area array device.

In one embodiment, the one or more circuit traces are disposed on the circuit board. The one or more circuit traces, in a further embodiment, are in electrical communication with the conductors within one or more of the holes. In one embodiment, the one or more electrical devices are coupled to the one or more circuit traces. The one or more electrical devices, in another embodiment, are in electrical communication with the conductors within one or more of the holes through the one or more circuit traces.

In one embodiment, the electrical connector is disposed on a perpendicular side of the circuit board. The electrical connector, in another embodiment, is coupled to the one or more circuit traces. The electrical connector, in a further embodiment, is in electrical communication with the conductors within one or more of the holes through the one or more circuit traces.

In one embodiment, the seating portion of each contact post is disposed between the compliant portion and the spring portion. In a further embodiment, the seating portion has a width that is greater than a diameter of a hole. The seating portion, in another embodiment, is disposed against the side of the circuit board to prevent further insertion of the contact posts into the plurality of holes.

In one embodiment, the housing is disposed adjacent to the circuit board on the side of the circuit board. The housing, in a further embodiment, substantially circumscribes the plurality of contact posts. In another embodiment, at least a part of the spring portion of each contact post extends beyond a surface of the housing that faces away from the circuit board. The surface of the housing, in one embodiment, is formed to receive the area array device. In a further embodiment, the surface of the housing is positioned to prevent the contact posts from contacting each other in response to contact with the contact pads of the area array device. The housing, in another embodiment, comprises a plurality of slots that interface with the contact posts to removably secure the contact posts to the housing.

In one embodiment, the press device clamps the circuit board and the area array device together. In a further embodiment, the contact pads on the area array device contact the spring portions of the plurality of contact posts in response to the clamping of the press device, compressing the spring portions toward the circuit board.

A system of the present invention is also presented to provide electrical connections for an area array device. The system may be embodied by a circuit board, an area array device, a plurality of holes, a plurality of electrically conductive contact posts, a compliant portion of each contact post, and a spring portion of each contact post. In particular, the system, in one embodiment, includes a second plurality of electrically conductive contact posts, one or more circuit traces, one or more electrical devices, an electrical connector, a seating portion of each contact post, a housing, and a press device.

A method of the present invention is also presented for providing electrical connections for an area array device. The method in the disclosed embodiments substantially includes the steps necessary to carry out the functions presented above with respect to the operation of the described apparatus and system. In one embodiment, the method includes forming a plurality of holes within a circuit board. Each hole, in a further embodiment, comprises a conductor within the hole and an opening on a side of the circuit board.

The method, in a further embodiment, includes forming a plurality of electrically conductive contact posts. In another embodiment, the method includes forming a compliant portion on an end of each contact post. In a further embodiment, the compliant portion is sized for compressible insertion within one of the holes. In one embodiment, the method includes forming a spring portion on an opposite end of each contact post. In another embodiment, the spring portion is compressible toward the compliant portion.

In one embodiment, the method includes inserting the compliant portion of the plurality of contact posts into the openings of at least a portion of the plurality of holes. The compliant portions, in a further embodiment, are inserted in a pattern corresponding to contact pads disposed on an area array device. In another embodiment, the conductors within the holes compress the compliant portions to removably secure the contact posts within the holes and to provide electrical connections between the contact posts and the conductors. In one embodiment, the spring portions extend away from the circuit board. In a further embodiment, the spring portions are compressible toward the circuit board in response to contact with the contact pads of the area array device. The spring portions, in another embodiment, provide electrical connections between the contact posts and the contact pads in response to the contact with the contact pad.

An additional apparatus to provide electrical connections for an area array device is provided. In one embodiment, the additional apparatus includes a plurality of holes disposed within a circuit board of a land grid array socket. Each hole, in one embodiment, comprises a conductor within the hole and an opening on a side of the circuit board.

In a further embodiment, a plurality of electrically conductive contact posts extends from the openings of at least a portion of the plurality of holes. The plurality of contact posts, in one embodiment, is disposed in a pattern corresponding to contact pads disposed on an area array device.

In one embodiment, a compliant portion of each contact post comprises an eye of the needle compliant pin section. The compliant portion, in a further embodiment, is inserted within one of the plurality of holes. In another embodiment, the conductor within the hole compresses the eye of the needle to removably secure the contact post within the hole and to provide an electrical connection between the contact post and the conductor within the hole.

In another embodiment, a spring portion of each contact post extends away from the circuit board. The spring portion, in one embodiment, comprises a cantilever beam that is compressible toward the circuit board in response to contact with a contact pad of the area array device. In a further embodiment, the spring portion provides an electrical connection between the spring portion and the contact pad in response to the contact with the contact pad.

A third apparatus is provided to provide electrical connections for an area array device. The third apparatus, in one embodiment, includes a plurality of holes, a plurality of electrically conductive contact posts, a compliant portion of each contact post, a spring portion of each contact post, a seating portion of each contact post, a housing, a second plurality of electrically conductive contact posts, one or more circuit traces, one or more electrical devices, and an electrical conductor.

The plurality of holes, in one embodiment, is disposed within an interposing circuit board within a land grid array socket. In a further embodiment, each hole comprises a conductor within the hole and an opening on a side of the circuit board. The plurality of contact posts, in one embodiment, extends from the openings of at least a portion of the plurality of holes. The plurality of contact posts, in a further embodiment, is disposed in a pattern corresponding to contact pads on an area array device.

In one embodiment, the compliant portion of each contact post comprises an eye of the needle compliant pin section. The compliant portion, in a further embodiment, is inserted within one of the plurality of holes. In another embodiment, the conductor within the hole compresses the eye of the needle to removably secure the contact post within the hole and provides an electrical connection between the contact post and the conductor within the hole.

The spring portion of each contact post, in one embodiment, extends away from the circuit board. In a further embodiment, the spring portion comprises a cantilever beam that is compressible toward the circuit board in response to contact with a contact pad of the area array device. The spring portion, in another embodiment, provides an electrical connection between the spring portion and the contact pad in response to the contact with the contact pad.

The seating portion of each contact post, in one embodiment, is disposed between the compliant portion and the spring portion. The seating portion, in a further embodiment, has a width greater than a diameter of a hole. In another embodiment, the seating portion is disposed against the side of the circuit board to prevent further insertion of the contact posts into the plurality of holes.

In one embodiment, the housing is disposed adjacent to the circuit board on the side of the circuit board. The housing, in a further embodiment, substantially circumscribes the plurality of contact posts. In another embodiment, at least a part of the spring portion of each contact post extends beyond a surface of the housing that faces away from the circuit board. The surface of the housing, in one embodiment, is formed to receive the area array device. In another embodiment, the surface of the housing is positioned to prevent the contact posts from contacting each other in response to contact with the contact pads of the area array device. The housing, in a further embodiment, comprises a plurality of slots that interface with the contact posts to removably secure the contact posts to the housing.

The second plurality of electrically conductive contact posts, in one embodiment, extends from opposite openings of at least a portion of the plurality of holes. In another embodiment, the opposite openings are disposed in an opposite side of the circuit board and the conductors within the holes extend between the openings and the opposite openings. In another embodiment, the second plurality of contact posts is disposed in a pattern corresponding to contact pads on a second area array device. The circuit board, in a further embodiment, comprises an interposer between the area array device and the second area array device.

In one embodiment, the one or more circuit traces are disposed on the circuit board and are in electrical communication with the conductors within one or more of the holes. The one or more electrical devices, in a further embodiment, are coupled to the one or more circuit traces and are in electrical communication with the conductors within one or more of the holes through the one or more circuit traces. In another embodiment, the electrical connector is disposed on a perpendicular side of the circuit board and is coupled to the one or more circuit traces. The electrical connector, in a further embodiment, is in electrical communication with the conductors within one or more of the holes through the one or more circuit traces.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

As will be appreciated by one skilled in the art, aspects of the present invention may be embodied as an apparatus, system, or method. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Aspects of the present invention are described below with reference to schematic flowchart diagrams and/or schematic block diagrams of methods, apparatuses, and systems according to embodiments of the invention. In some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and computer instructions.

Figure 1:
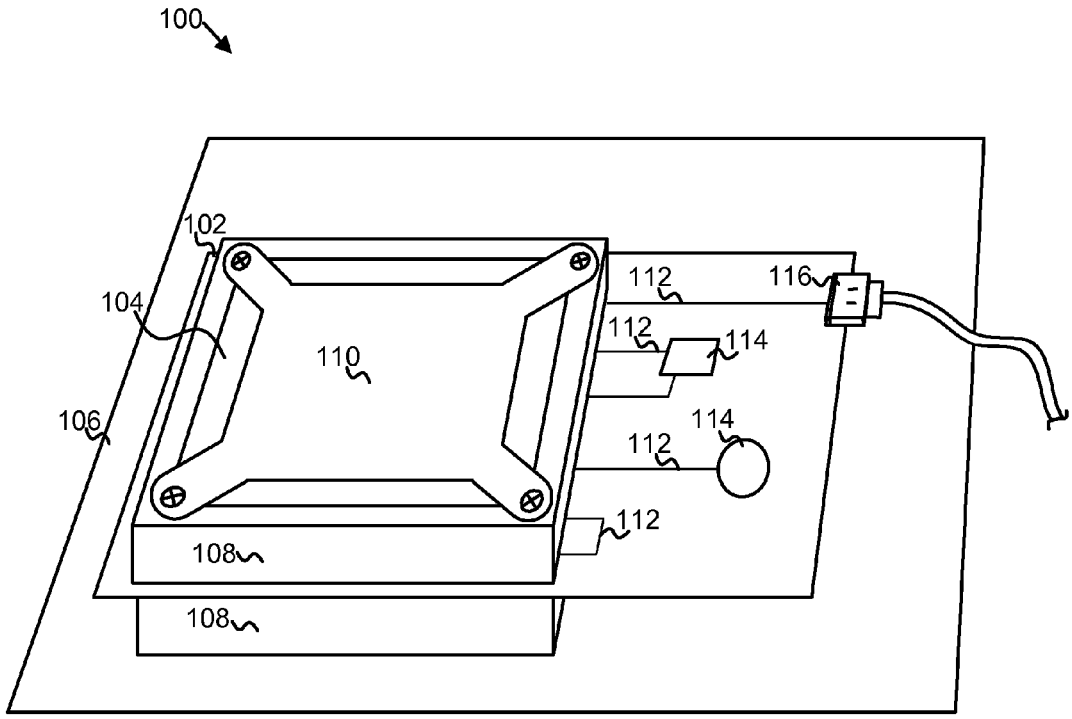
FIG. 1 is a schematic block diagram illustrating one embodiment of a system to provide electrical connections for an area array device in accordance with the present invention.

FIG. 1 depicts one embodiment of a system 100 to provide electrical connections for an area array device 104. In the depicted embodiment, the system 100 includes a circuit board 102, an area array device 104, a second area array device 106, one or more housings 108, a press device 110, one or more circuit traces 112, one or more electrical devices 114, and an electrical connector 116. The system 100 provides integral connections both between contact pads of the area array devices 104, 106 and from contact pads of the area array devices 104, 106 to external circuitry.

In the depicted embodiment, the circuit board 102 is an interposer in an area array device socket, providing electrical connections for the area array device 104 and the second area array device 106. In a further embodiment, instead of being interposed between the area array device 104 and the second area array device 106, the circuit board 102 may be a base circuit board to which the area array device 104 is connected, without a second area array device 104. In the depicted embodiment, the circuit board 102 provides electrical connections for the area array device 104, 106 using removable, compressible contact posts or pins that are inserted into holes in the circuit board 102.

The circuit board 102, in one embodiment, is a planar element that provides structural support to the area array device 104 as well as electrical connections. The circuit board 102 may have multiple layers, such as electrically conductive layers, insulating layers, structural support layers, stiffening layers, heat dissipation layers, and the like. For example, in one embodiment, the circuit board 102 may be a printed circuit board, a laminate, a spacer, a substrate, or the like. In a further embodiment, the circuit board 102 includes one or more copper sheets laminated onto a non-conductive dielectric substrate using epoxy resin or the like.

The circuit board 102 has multiple holes (not shown) disposed within the circuit board 102. Each hole has a conductor within it, and an opening on one or both sides of the circuit board 102. The holes, in one embodiment, may be vias within the circuit board 102, and the conductor may be plating, solder, wire, rivets, or the like within the holes. In one embodiment, the holes are through holes with openings on opposite sides of the circuit board 102, and the conductors provide electrical connections through the holes from one side of the circuit board 102 to the other side.

The circuit board 102 also has contact posts (not shown) extending from at least some of the holes. The contact posts are electrically conductive, and provide the electrical connections for the area array device 104 and the second area array device 106. In the depicted embodiment, a first group of contact posts extends from the openings in the holes toward the area array device 104 and a second group of contact posts extends from opposite openings in the holes toward the second area array device 106. In a different embodiment, the circuit board 102 may only have contact posts on a single side of the circuit board 102, providing electrical connections to a single area array device 104.

The first group of contact posts is in a pattern that corresponds to contact pads on the area array device 104, and the second group of contact posts is in a pattern that corresponds to contact pads on the second area array device 106. The patterns of the first group of contact posts and the second group of contact posts may be the same, such that there is a one-to-one direct connection between the area array device 104 and the second area array device 106, or the patterns may be different.

As will be described in greater detail with regard to FIG. 4A and FIG. 4B, each contact post has a compliant portion and a spring portion. The compliant portion is inserted within a hole to removably secure the contact post within the hole and to electrically connect the contact post to the conductor within the hole. The spring portion extends away from the circuit board 102 and is compressible toward the circuit board 102. The spring portion contacts the contact pads on one of the area array devices 104, 106, providing an electrical connection between an area array device 104, 106 and the contact post. The contact posts may further have a seating portion that interfaces with the circuit board 102 to orient the compliant portion within a hole to prevent further insertion of a contact post within the hole.

In one embodiment, the area array device 104 is an integrated circuit device, circuit board, or the like with an array of electrical contact pads disposed on one side. For example, in one embodiment, the area array device 104 may be a land grid array ("LGA") device such as a processor or the like. The area array device 104 may be an integrated circuit itself, an integrated circuit mounted on a substrate, a circuit board, a circuit board with one or more electrical components, or the like. The contact pads on the area array device 104 are electrically conductive, comprising one or more materials such as copper, gold, nickel, and the like. The contact pads may comprise an alloy, may be plated, or may be otherwise finished or treated to facilitate electrical connections, prevent corrosion, and the like.

In one embodiment, the second area array device 106 is an area array device that is configured for interfacing with the area array device 104. The second area array device 106 may be substantially similar to the area array device 104 described above. In one embodiment, the area array device 104 is an integrated circuit device and the second area array device 106 is a circuit board upon which the area array device 104 is mounted, with the circuit board 102 as an interposer that provides electrical connections between the area array device 104 and the second area array device 106.

In one embodiment, the one or more housings 108 provide structural support between the circuit board 102 and the area array device 104 and/or the second area array device 106. The one or more housings 108, in the depicted embodiment, are disposed adjacent to the circuit board 102. The one or more housings 108 circumscribe the contact posts.

Each housing 108 has a surface that is formed to receive and interface with an area array device 104, 106. At least part of the spring portions of the contact posts extend beyond the surface of a housing 108, to contact the contact pads on an area array device 104, 106. The surface of a housing 108, in one embodiment, is positioned to prevent contact posts from contacting each other as the spring portion compresses toward the circuit board 102. The housings 108 may further include slots that interface with the contact posts to removably secure the contact posts to the housings 108. The one or more housings 108 are discussed in greater detail with regard to FIG. 8.

In one embodiment, the press device 110 clamps the circuit board 102 and the area array devices 104, 106 together. The press device 110 forces the contact pads on the area array devices 104, 106 into contact with the spring portions of the contact posts, compressing the spring portions toward the circuit board 102 to form electrical connections with the contact pads. The press device 110 may include one or more clamping plates, clamping levers, fasteners, hinges, connectors, and the like to provide the clamping force.

In one embodiment, the one or more circuit traces 112 are disposed on the circuit board 102. The circuit traces 112 provide electrical connections to and from the conductors in the holes in the circuit board 102, which are electrically connected to the contact pads of the area array devices 104, 106.

Figure 3:
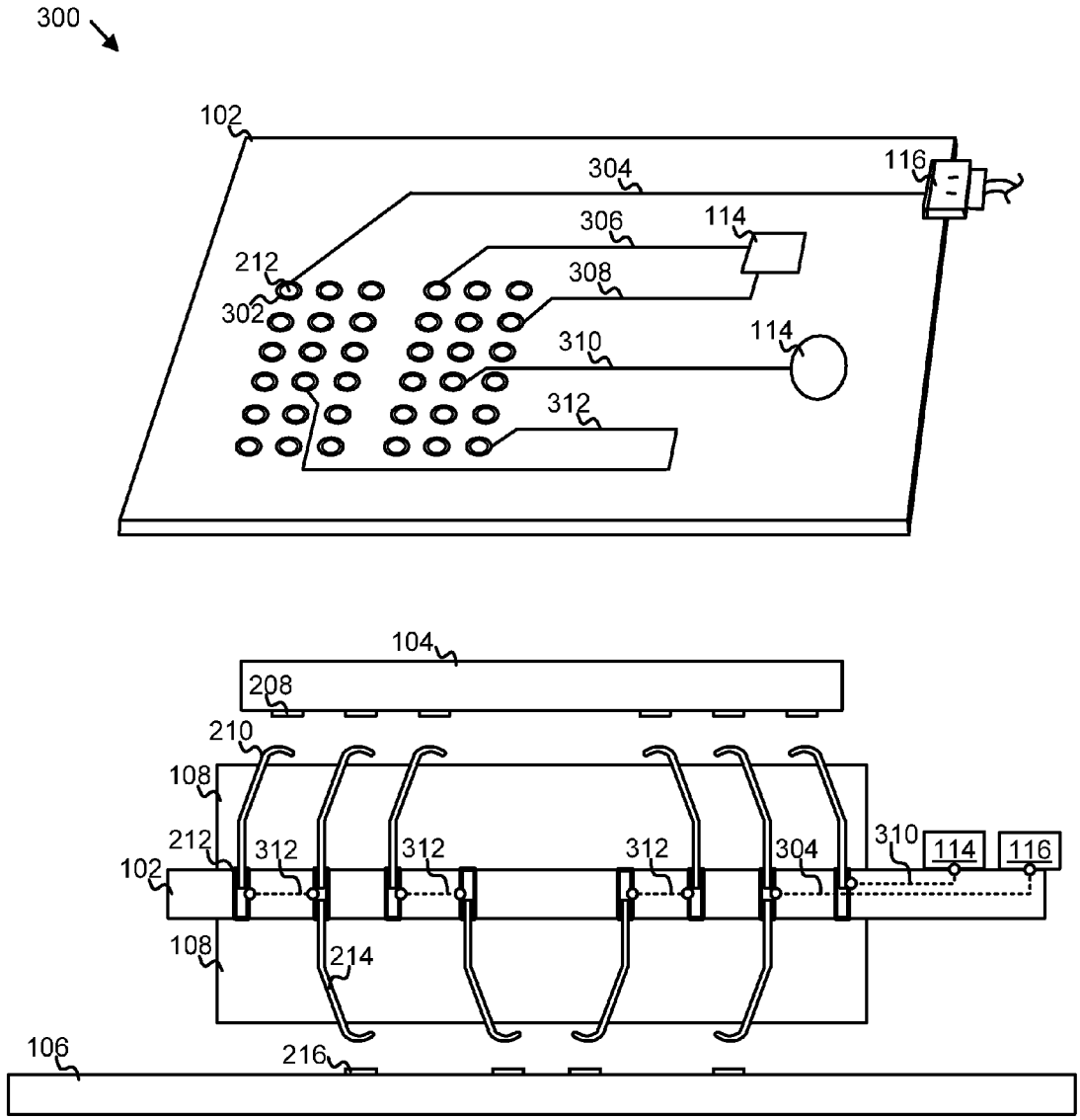
FIG. 3 is a schematic block diagram illustrating one embodiment of a circuit board in accordance with the present invention.

The circuit traces 112 are described in greater detail with regard to FIG. 3. In general, the circuit traces 112 may connect the conductors to other conductors in other holes, to the one or more electrical devices 114 mounted on the circuit board 102, to the electrical connector 116, and the like. The circuit traces 112 provide integral connections to the contact pads on the area array devices 104, 106, increasing the utility and the configurability of the system 100.

In one embodiment, the one or more electrical devices 114 are mounted on the circuit board 102 and are electrically connected to the circuit traces 112. The electrical devices 114 may include active or passive electrical components, such as communications devices, voltage regulators, resistors, capacitors, and the like. The electrical devices 114 may include discrete or integrated electrical devices.

In one embodiment, the electrical connector 116 connects a circuit trace 112 to an external component or device. The electrical connector 116 may be a port, socket, or other connector that provides an electrical or optical connection to an external component, allowing electrical or fiber optic communications between the external component and the one or more area array devices 104, 106.

Because the circuit traces 112, the electrical devices 114, and the electrical connector 116 are located on the circuit board 102 as part of an intermediate layer or interposer in the system 100, they relieve some of the wiring congestion on the second area array device 106. The second area array device 106, in one embodiment, includes one or more additional circuit traces, electrical devices, electrical connectors, and the like.

For example, in one embodiment, connections to some contact pads on the area array device 104 may be connected directly through to contact pads on the second area array device 106, some may be connected to the electrical devices 114 or the electrical connector 116, and others may be connected to both. In a further embodiment, contact pads from the area array device 104 may be connected to other contact pads on the area array device 104. Connections from contact pads on the area array device 104, in another embodiment, may be rerouted to contact pads on the second area array device 106 that do not correspond to the same holes in the circuit board 102. The system 100 provides a high level of configurability and flexibility in making connections with the area array device 104.

Figure 2:
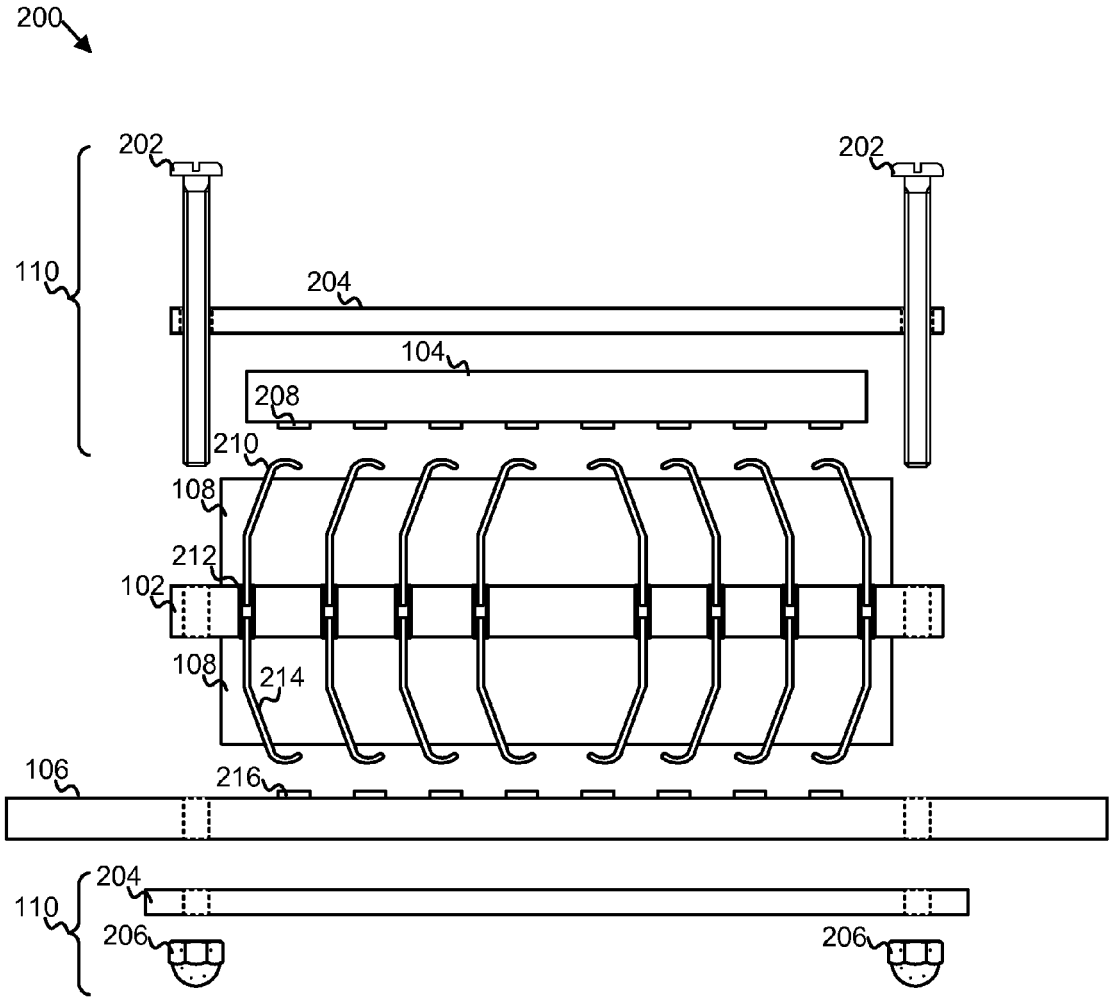
FIG. 2 is a schematic block diagram illustrating another embodiment of a system to provide electrical connections for an area array device in accordance with the present invention.

FIG. 2 depicts an exploded cross sectional view of one embodiment of a system 200 to provide electrical connections for the area array device 104. In the depicted embodiment, the system 200 includes the circuit board 102, the area array device 104, the second area array device 106, the one or more housings 108, and the press device 110. In one embodiment, the system 200 may be substantially similar to the system 100 described with regard to FIG. 1.

In one embodiment, the circuit board 102 includes a group of holes 212, a group of contact posts 210, and a second group of contact posts 214. Examples of the holes 212, the contact posts 210, and the second group of contact posts 214 are described above with regard to the circuit board 102 of FIG. 1.

In the depicted embodiment, each hole 212 in the group of holes 212 in the circuit board 102 is a through hole, with openings on two opposite sides of the circuit board 102. Each of the holes 212 has a conductor within it, providing electrical connections between the openings of the holes 212.

In the depicted embodiment, each of the contact posts 210 is removably inserted within an opening of the holes 212. The conductors in the holes 212 compress compliant portions of the contact posts 210 to create an electrical connection between the contact posts 210 and the conductors, and to secure the contact posts 210 within the holes 212. Spring portions of the contact posts 210 extend beyond the housing 108 toward contact pads 208 on the area array device 104.

In the depicted embodiment, the spring portions of the contact posts 210 are cantilever beams, and the group of contact posts 210 is divided into two groups of oppositely facing contact posts 210. The oppositely facing contact posts 210 balance a force from the wiping action of the cantilever beams on the contact posts 210 in response to the cantilever beams being pressed toward the circuit board 102 by the contact pads 208 of the area array device 104. In another embodiment, the contact posts 210 may be arranged in a different balancing configuration, such as multiple groups each facing diagonally toward a center of the circuit board 102, or the like. The contact posts 210 are arranged in a pattern corresponding to the contact pads 208 on the area array device 104, so that the spring portions of the contact posts 210 are in contact with the contact pads 208 when compressed toward the circuit board 102.

In the depicted embodiment, each of the second group of contact posts 214 are removably inserted within opposite openings of the holes 212, such that the conductors within the holes 212 connect the first group of contact posts 210 and the second group of contact posts 214. Each contact post 214 in the second group of contact posts 214 extend from the circuit board 102 toward contact pads 216 on the second area array device 106.

The system 200 may have various scales, depending on the size and density of the contact pads 208, 216 on the area array devices 104, 106. For example, in one embodiment, the holes 212 may have a diameter between about 10-25 mils. The compliant portion of the contact posts 210, 214, in one embodiment, is slightly larger than the diameter of the holes 212. In a further embodiment, the compliant portion of the contact posts 210, 214 is about twice as tall as it is wide, for example about 20-50 mils tall and about 10-25 mils wide. In an embodiment where the contact posts 210 are made from metallic sheets, such as copper, the contact posts 210 may be between about 2-6 mils thick.

In the depicted embodiment, the circuit board 102 is at least twice as thick as the height of compliant portions of the first group of contact posts 210 and the second group of contact posts 214, such that the first group of contact posts 210 and the second group of contact posts 214 do not contact each other within the holes 212. For example, in an embodiment where the compliant portion of the contact posts 210 is between about 20-25 mils in height, the circuit board 102 may be at least 40-50 mils thick to accommodate two compliant portions.

In the depicted embodiment, the conductors within the holes 212 provide an electrical connection between the contact posts 210 and the contact posts 214. In a further embodiment, the first group of contact posts 210 and the second group of contact posts 214 may contact, overlap, intertwine, interlock, or the like with each other within the holes 212. In an embodiment where the first group of contact posts 210 and the second group of contact posts 214 contact within the holes 212, the compliant portion of an opposite contact post 210, 214 may be the conductor within the hole 212, forming an electrical connection between the contact posts 210, 214 and/or removably securing the contact posts 210, 214 within the holes 212. In another embodiment, the first group of contact posts 210 and the second group of contact posts 214 may contact, overlap, intertwine, interlock, or the like such that a width of the circuit board 102 may be reduced to less than double the height of the compliant portions.

The contact pads 208, 216, in one embodiment, are made of an electrically conductive material, and may be metalized, plated, or the like to facilitate electrical connections between the contact pads 208, 216 and the contact posts 210, 214. The contact posts 210, 214 are disposed in patterns on the area array devices 104, 106 to correspond with the contact pads 208, 216.

In the depicted embodiment, the press device 110 includes one or more fasteners 202, one or more clamping members 204, and one or more corresponding fasteners 206. The press device 110 clamps the circuit board 102 and the area array devices 104, 106 together, forcing the contact pads 208, 216 into contact with the spring portions of the contact posts 210, 214.

In the depicted embodiment, a clamping member 204 is disposed on each side of the system 200 and the fasteners 202 engage with the corresponding fasteners 206 to compress the area array devices 104, 106 toward the circuit board 102. In the depicted embodiment, the fasteners 202 include screws, bolts, or the like that extend through openings in the clamping members 204, the circuit board 102, and the second area array device 106 to engage the corresponding fasteners 206, which are bolts. In a further embodiment, the press device 110 may include a hinge with clamping plates and a clamping lever, or may include a different press device.

FIG. 3 depicts one embodiment 300 of the circuit board 102. In the depicted embodiment 300, the circuit board 102 includes the group of holes 212, one or more circuit traces 304, 306, 308, 310, 312, the one or more electrical devices 114, and the electrical connector 116.

In one embodiment, the group of holes 212 each include a conductor 302 within the hole 212. The conductors 302 are electrically conductive, and may circumscribe each hole 212, may line a portion of each hole 212, or the like such that the conductors 302 compress compliant portions of the contact posts 210, 214. For example, in one embodiment, an interior wall of a hole 212 may be plated, metalized, lined, or the like with a conductive material such as copper, gold, nickel, an alloy, or the like that circumscribes the hole 212, or a conductor 302 may be placed along one or more strips within the hole 212. The design of the compliant portion of the contact posts 210, 214 may determine the type of conductor 302 used in the holes 212.

Each of the holes 212, in one embodiment, may extend through the circuit board 102 such that the first group of contact posts 210 may be inserted into a first opening of the holes 212 and the second group of contact posts 214 may be inserted into a second opening of the holes 212 to allow the circuit board 102 to be used as an interposer between the area array device 104 and the second area array device 106. In a further embodiment, the circuit board 102 is not an interposer, but is a base circuit board with the contact posts 210 on a single side of the circuit board 102, and the holes 212 may not be through holes, but may pass partially through the circuit board 102 and may have a single opening.

In one embodiment, the one or more circuit traces 304, 306, 308, 310, 312 are disposed on the circuit board 102 to provide integral electrical connections to and from the conductors 302 within the holes 212. In the depicted embodiment 300, the circuit trace 304 electrically connects a conductor 302 with the electrical connector 116. In a further embodiment, multiple circuit traces may connect additional conductors 302 with the electrical connector 116. The electrical connector 116, in the depicted embodiment 300, is disposed on a perpendicular side of the circuit board 102.

In one embodiment, the electrical connector 116 may include additional components to manipulate, translate, and/or transform signals to and from the conductor 302. For example, in one embodiment, the electrical connector 116 may include an optical transmitter and/or receiver to convert between electrical and optical signals for fiber optic communications. In a further embodiment, the electrical connector 116 may connect multiple circuit boards 102, for integral connections between multiple area array devices 104.

In the depicted embodiment 300, the circuit trace 306 connects one conductor 302 to an electrical device 114, and the circuit trace 308 connects another conductor 302 to the same electrical device 114. Additional circuit traces may connect more conductors 302 to the same electrical device 114 or to other electrical devices 114. As depicted, the circuit trace 310 connects a conductor 302 to an electrical device 114. The circuit trace 312, as depicted, connects a conductor 302 in a first hole 212 with a conductor 302 in a second hole 212. The circuit trace 312, in a further embodiment, may connect more than two conductors 302 from more than two holes 212.

Figure 4A:
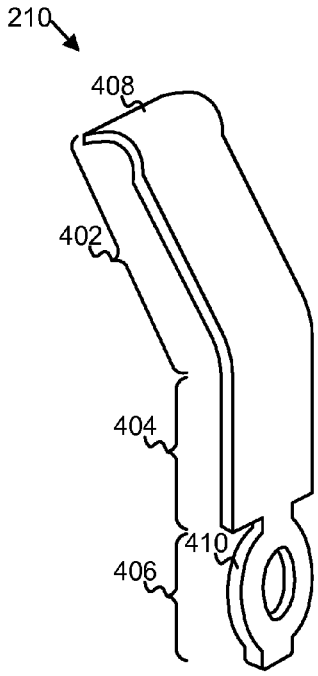
FIG. 4A is a schematic block diagram illustrating one embodiment of a contact post in accordance with the present invention.

FIG. 4A depicts one embodiment of the contact post 210. In the depicted embodiment, the contact post 210 has a spring portion 402, a seating portion 404, and a compliant portion 406. As depicted, the spring portion 402 is on a first end of the contact post 210 and the compliant portion 406 is on an opposite end of the contact post 210, with the seating portion 404 between the spring portion 402 and the compliant portion 406.

The contact post 210 is electrically conductive, and may be constructed of a single, continuous material, or may be constructed of separate materials that are connected to form a structural and electrical connection. For example, in one embodiment, the contact post 210 may be stamped from a single sheet of copper, or the like. In another embodiment, a spring portion 402, such as a radial spring or fuzz button, may be welded, soldered, or otherwise structurally and electrically connected to a compliant portion 406.

Figure 5A:
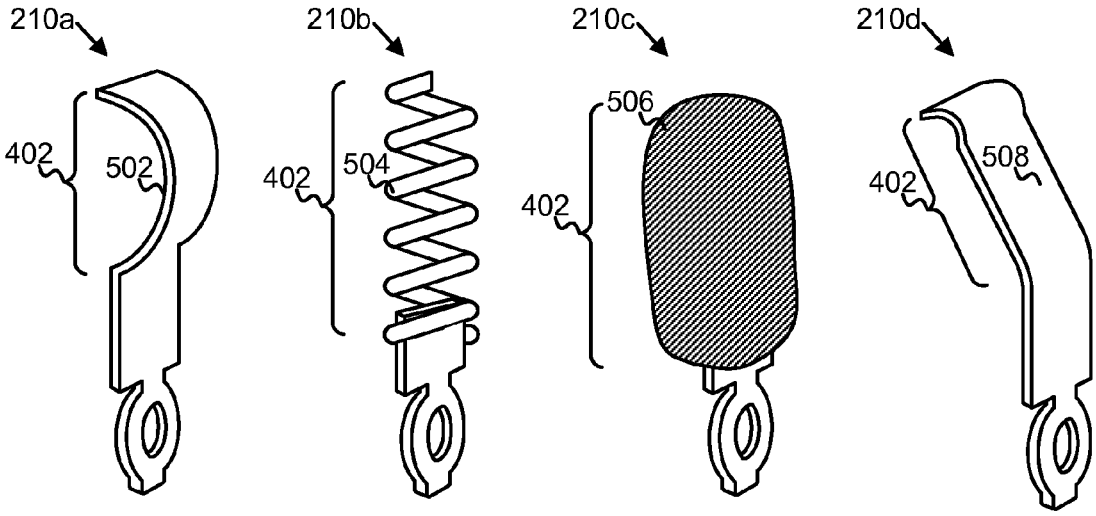
FIG. 5A is a schematic block diagram illustrating embodiments of spring portions of a contact post in accordance with the present invention.

The spring portion 402 provides an electrical connection between a contact pad 208, 216 and the contact post 210 at a contact tip 408 of the contact post 210. The spring portion 402 is compressible, such that the contact tip 408 is pressed against a contact pad 208, 216. In the depicted embodiment, the spring portion 402 is a cantilever beam that compresses by bending at a joint. Other embodiments of the spring portion 402, such as a C spring, a radial spring, and a fuzz button are depicted in FIG. 5A.

The seating portion 404, in one embodiment, has a width that is greater than a diameter of a hole 212. As the compliant portion 406 is inserted into a hole 212, the seating portion 404 contacts the side of the circuit board 102 around the hole 212, preventing further insertion of the contact post 210 into the hole 212. In another embodiment, the seating portion 404 may be positioned and shaped to orient the compliant portion 406 within a hole 212. In a further embodiment, the seating portion 404 may interface with the housing 108 to secure the contact post 210 to the housing 108.

In one embodiment, the compliant portion 406 is inwardly compressible, and has a width that is slightly greater than a diameter of a hole 212. As the compliant portion 406 is inserted into a hole 212, the wall of the hole 212 and/or the conductor 302 within the hole 212 compresses the compliant portion 406. Once compressed, the compliant portion 406 presses outward, removably securing the contact post 210 within the hole 212 and making an electrical connection with the conductor 302.

Figure 5B:
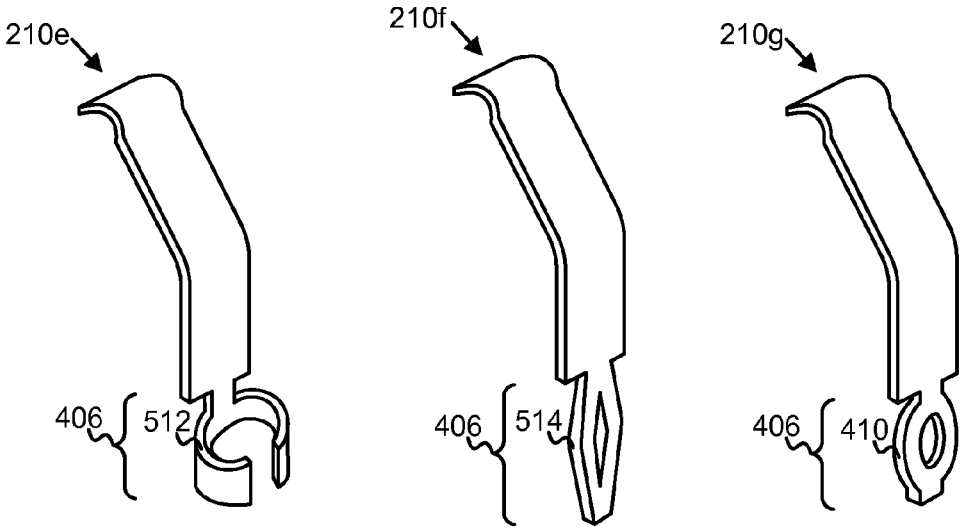
FIG. 5B is a schematic block diagram illustrating embodiments of compliant portions of a contact post in accordance with the present invention.

In the depicted embodiment, the compliant portion 406 is an eye of the needle compliant pin section 410. The arms of the eye of the needle compliant pin section 410 bend inward in response to pressure from a wall of the hole 212 and/or the conductor 302 within the hole 212. Other embodiments of the compliant portion 406, such as a C shaped compliant structure and a split pin, are depicted in FIG. 5B.

Figure 4B:
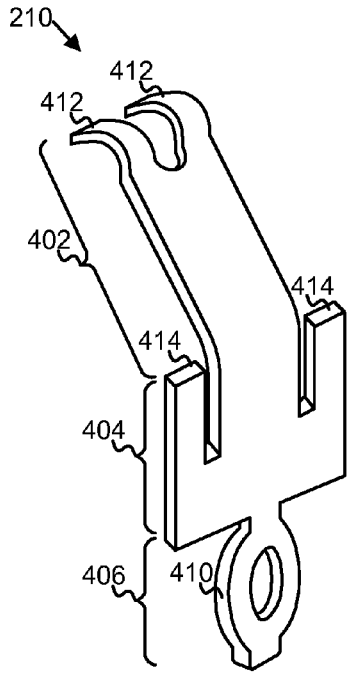
FIG. 4B is a schematic block diagram illustrating another embodiment of a contact post in accordance with the present invention.

FIG. 4B depicts another embodiment of the contact post 210. In the depicted embodiment, the spring portion 402 includes a split contact tip 412. A split contact tip 412, due to its multiple contacts, may provide a more consistent connection with a contact pad 208, 216. The seating portion 404, as depicted, includes one or more carrier strips 414. The carrier strips 414, in one embodiment, facilitate insertion of the contact post 210 within a hole 212. The carrier strips 414 may be manufacturing remnants from a reel of contact posts 210, or may be designed expressly to facilitate insertion of the contact posts 210 into the holes 212. In a further embodiment, the seating portion 404 may not include the carrier strips 414, but may still be wider than the spring portion 402 to provide a surface for pressing the contact post 210 into a hole 212.

FIG. 5A depicts four embodiments of the spring portions 402 of the contact posts 210. In the depicted embodiments, the contact post 210*a* has a C spring 502, the contact post 210*b* has a radial spring 504, contact post 210*c* has a fuzz button 506, and contact post 210*d* has a cantilever beam 508. Many other designs for the spring portion 402 are possible, and the contact posts 210 may include another type of spring portion 402 that is electrically conductive and compressible toward the compliant portion 406.

Each spring portion 402, in the depicted embodiments, is compressible and electrically conductive. The contact post 210*a* is made from a single piece of material, with the C spring 502 bent to form the spring portion 402. As depicted, the radial spring 504 is attached to the contact post 210*b* by welding, soldering, or the like to form a continuous structural and electrical connection. Similarly, in the depicted embodiment, the fuzz button 506, a compacted mass of small wires, is attached to the contact post 210*c* to form a structural and electrical connection. The C spring 502, the radial spring 504, and the fuzz button 506 are each shaped to compress along a vertical axis in response to a compression force.

The cantilever beam 508 of the contact post 210*d* is substantially similar to the spring portion 402 depicted in FIG. 4A and FIG. 4B. The cantilever beam 508 is formed in the contact post 210*d* by bending a single piece of material to form the spring portion 402 of the contact post 210*d*. The cantilever beam 508, in one embodiment, may move in an arc along both a vertical axis and a horizontal axis in response to a compression force, creating the wiping action described with regard to the contact posts 210 of FIG. 2.

FIG. 5B depicts three embodiments of the compliant portions 406 of the contact posts 210. In the depicted embodiments, the contact post 210*e* has a C shaped compliant structure 512, the contact post 210*f* has a split pin 514, and the contact post 210*g* has the eye of the needle compliant pin section 410. Like the spring portion 402, many other designs for the compliant portion 406 are possible, and the contact posts 210 may include another type of compliant portion 406 that is compressibly insertable within a hole 212 to form an electrical connection with the conductor 302 within the hole 212.

The C shaped compliant structure 512 of the contact post 210*e* is a C shaped bend at an end of the contact post 210*e* to form the compliant portion 406. The C shaped compliant structure 512 is formed with a gap between ends, such that the C shaped compliant structure 512 bends inwardly upon itself in response to a compression force from a wall of a hole 212 and/or a conductor 302 within a hole 212. Bending inwardly reduces the diameter of the C shaped compliant structure 512 allowing insertion of the C shaped compliant structure 512 in a hole 212. In another embodiment, the C shaped compliant structure 512 may face downward, and may be bent, stamped, or otherwise formed in a downward facing C shape.

The split pin 514 of the contact post 210*f* has an elongated pin structure with two or more arms that are displaced outwardly from the pin structure. The arms of the split pin 514 are displaced along an axis of the elongated pin structure, for example side to side, front to back, diagonally, or the like. In the depicted embodiment, the arms of the split pin 514 are joined at the top and bottom, with a split in the middle. In another embodiment, the arms of the split pin 514 may be joined at a single end and open at another end.

The eye of the needle compliant pin section 410 of the contact post 210*g* has an eye, or hole in an elongated pin structure with walls of the eye bent or deformed outwardly around the eye. The walls or arms of the eye in the eye of the needle compliant pin section 410 are compressible inward toward the eye. The eye of the needle compliant pin section 410, in one embodiment, is formed by piercing an elongated pin structure, forming the eye and forcing the walls of the eye outward. In a further embodiment, an outward facing surface of the eye of the needle compliant pin section 410 may be coined or the like after formation to prevent damage to the conductors 302 and/or the holes 212.

Figure 6A:
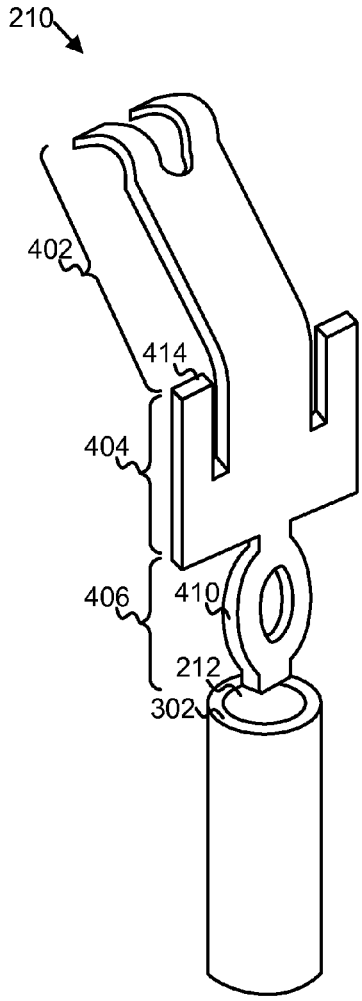
FIG. 6A is a schematic block diagram illustrating one embodiment of a contact post and a hole in accordance with the present invention.

FIG. 6A depicts one embodiment of the contact post 210 and the hole 212. In the depicted embodiment, the compliant portion 406 has an eye of the needle compliant pin section 410 that has a width that is slightly greater than a diameter of the hole 212 prior to insertion within the hole 212. The hole 212, as depicted, is plated or otherwise lined with the conductor 302.

Figure 6B:
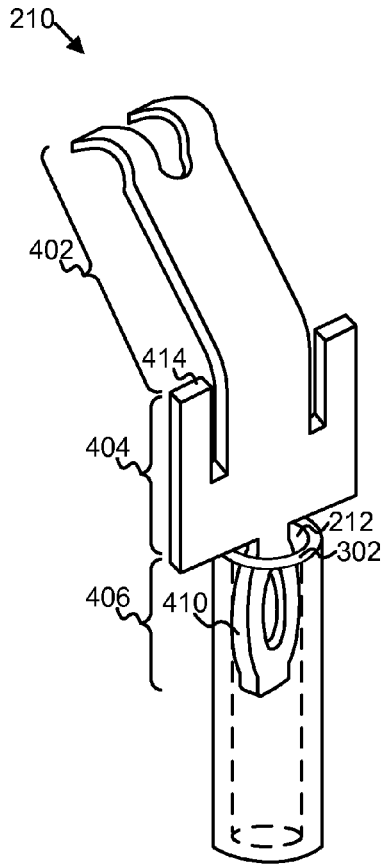
FIG. 6B is a schematic block diagram illustrating one embodiment of a contact post inserted in a hole in accordance with the present invention.

FIG. 6B depicts one embodiment of the contact post 210 inserted into the hole 212. As depicted, the compliant portion 406 is compressed by the conductor 302, to removably secure the compliant portion 406 within the hole 212 and to form an electrical connection between the conductor 302 and the contact post 210. In the depicted embodiment, the arms of the eye of the needle compliant pin section 410 are compressed inward by the conductor 302.

The seating portion 404, in the depicted embodiment, is seated against the upper surface of the hole 212 in the circuit board 102 (not shown). The seating portion 404 prevents further insertion of the compliant portion 406 into the hole 212. As depicted, the hole 212 is at least twice as long as the compliant portion 406, allowing for a second contact post 214 to be inserted in an opposite opening of the hole 212.

The seating portion 404 also ensures that each contact post 210 is inserted into a hole 212 at a consistent depth, so that the spring portions 402 each contact a contact pad 208, 216. The contact post 210, in the depicted embodiment, also includes a carrier strip 414, which may facilitate insertion of the contact post 210 into the hole 212 by providing a surface upon which an installing person or device may exert pressure.

As depicted, the contact post 210 is removable from the hole 212. This provides flexibility in repairing and configuring the circuit board 102. In one embodiment, the compliant portion 406 deforms the hole 212 and/or the conductor 302 to a certain degree upon insertion. In certain embodiments, this may cause the hole 212 to no longer secure a contact post 210 or the conductor 302 to no longer provide an electrical connection after too many repeated insertions and removals.

Figure 7:
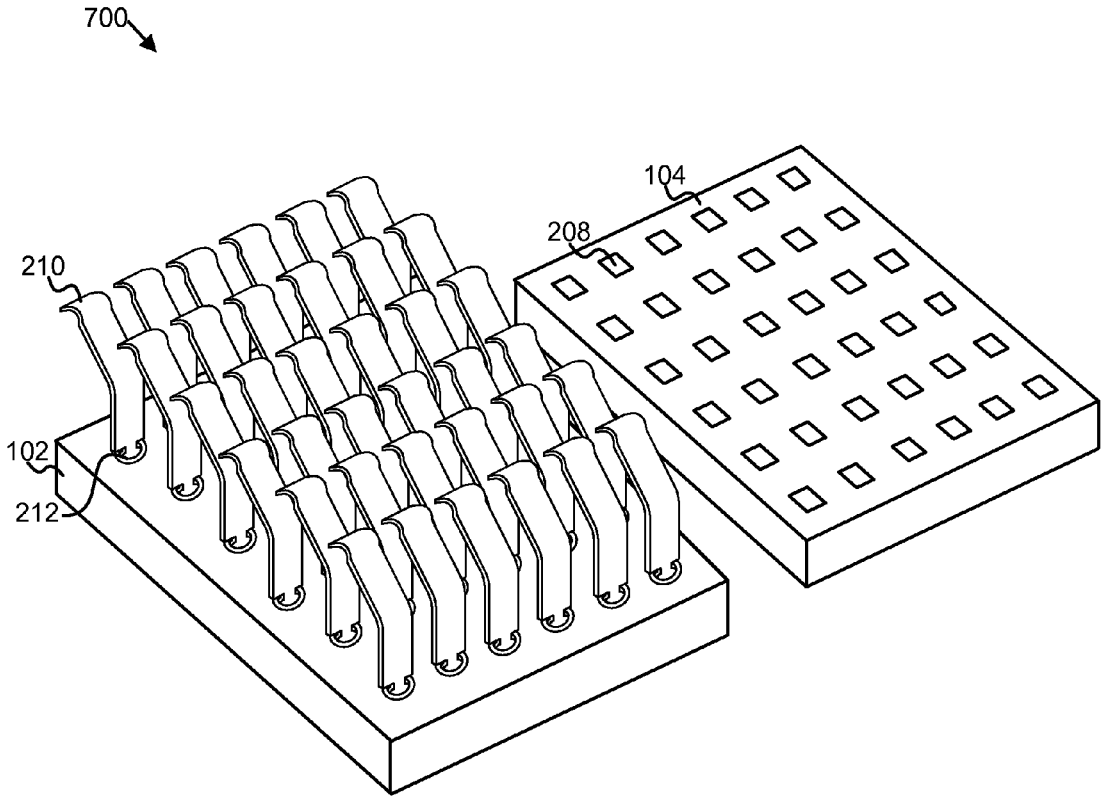
FIG. 7 is a schematic block diagram illustrating one embodiment of a circuit board and area array device in accordance with the present invention.

FIG. 7 depicts one embodiment 700 of the circuit board 102 and the area array device 104. In the depicted embodiment 700, the group of contact posts 210 is inserted into the group of holes 212 in the circuit board 102. The group of contact posts 210 forms a rectangular pattern on the circuit board 102, in six by six rows and columns.

As depicted, the contact pads 208 on the area array device 104 form a similar rectangular pattern in six by six rows and columns, corresponding to the pattern of the contact posts 210. The area array device 104 is illustrated as flipped, to show the pattern of contact pads 208. During installation of the area array device 104, the contact pads 208 are oriented facing the contact posts 210 and clamped toward the contact posts 210 such that each contact post 210 forms an electrical connection with a contact pad 208. Although the contact posts 210 and contact pads 208 are depicted in a six by six array in a rectangular pattern for illustration purposes, other embodiments may include hundreds or thousands of contact posts 210 and contact pads 208 in more complex patterns.

Figure 8:
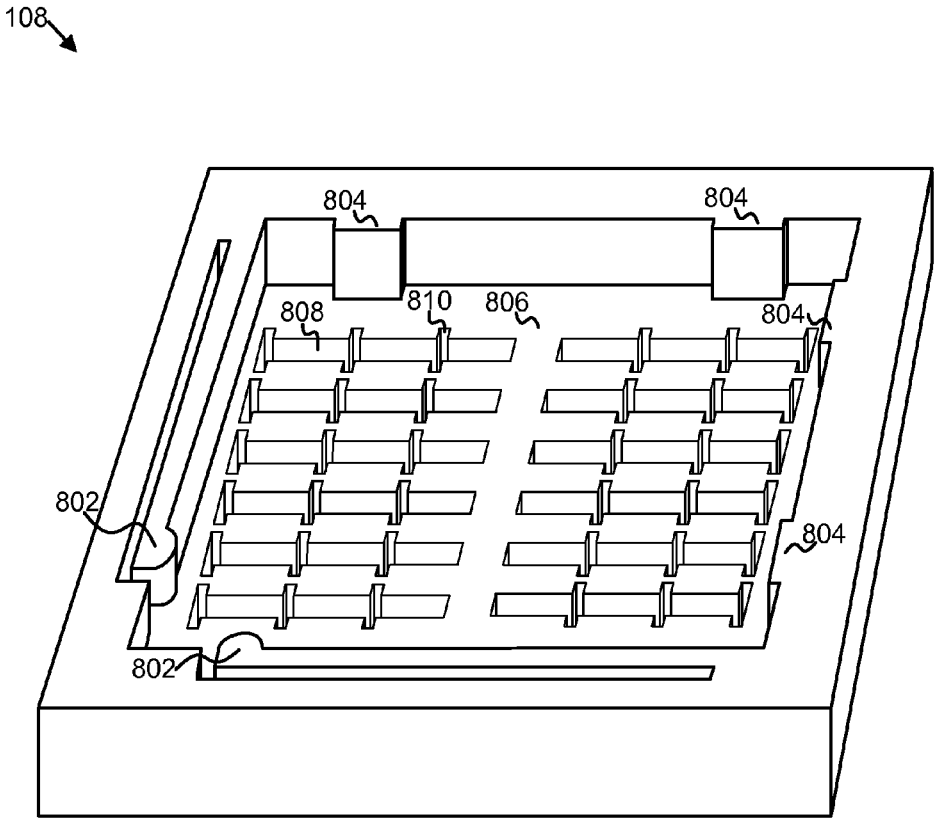
FIG. 8 is a schematic block diagram illustrating one embodiment of a housing in accordance with the present invention.

FIG. 8 depicts one embodiment of the housing 108. In the depicted embodiment, the housing 108 includes one or more securing members 802, one or more alignment members 804, a surface 806, one or more openings 808, and one or more slots 810. The housing 108, in one embodiment, is formed of a durable, insulating material, such as a plastic, ceramic, or the like.

In one embodiment, the one or more securing members 802 apply pressure to the area array device 104. The securing members 802 may help align the area array device 104 within the housing 108, and may help the press device 110 clamp the area array device 104. In the depicted embodiment, the securing members 802 are compressible, allowing the area array device 104 to be installed in the housing 108. In one embodiment, the one or more alignment members 804 align the area array device 104 within the housing 108. The securing members 802, in one embodiment, press the area array device 104 against the alignment members 804 to align the contact posts 210 with the contact pads 208.

In one embodiment, the surface 806 is formed to receive the area array device 104. The securing members 802 and/or the alignment members 804 may position the area array device 104 to align the area array device 104 relative to the surface 806. In the depicted embodiment, the one or more openings 808 are in the surface 806. At least a part of the spring portions 402 of the group of contact posts 210 extend through the openings 808 beyond the surface 806 to contact the contact pads 208.

The surface 806, in one embodiment, is positioned to prevent the contact posts 210 from contacting each other as they are compressed by the contact pads 208. Some types of spring portions 402, such as the cantilever beam 508, move along both a vertical axis and a horizontal axis in response to a compression force, and may contact other contact posts 210 if compressed too far. The surface 806, in one embodiment, may prevent the contact posts 210 from compressing beyond a predefined point based on how far the contact posts 210 extend beyond the surface 806 of the housing 108, preventing contact between the contact posts 210.

In one embodiment, the one or more slots 810 are in the openings 808 to interface with the contact posts 210. The slots 810 may removably secure the contact posts 210 to the housing 108, and align the contact posts 210 relative to the housing 108. For example, in one embodiment, a portion of the contact posts 210, such as the seating portion 404, may be wider than the spring portion 402, and may have an interference fit with the slots 810. Each slot 810 may pass through the entire housing 108, or may pass partially through the housing 108 to align the contact posts 210 vertically within the openings 808.

In one embodiment, the housing 108 may be joined to, formed with, or otherwise integrated with the circuit board 102. For example, in one embodiment, the circuit board 102 may be a base portion of the housing 108, with the holes 212 forming a base of the slots 810, and the conductors 302 may be within the holes 212 at the base of the slots 810. In another embodiment, one or more connectors or fasteners, the contact posts 210, the press device 110, or the like connect the housing 108 to the circuit board 102. The housing 108 may include one or more additional openings, connectors, fasteners, alignment features, or the like (not shown) to facilitate connection, alignment, or integration with the circuit board 102.

Figure 9:
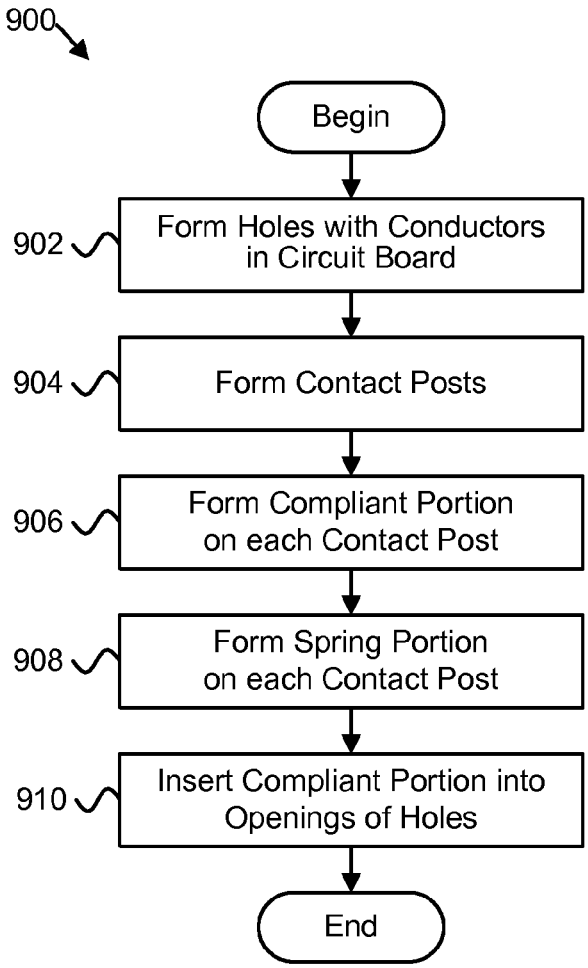
FIG. 9 is a schematic flow chart diagram illustrating one embodiment of a method for providing electrical connections for an area array device in accordance with the present invention.

FIG. 9 depicts one embodiment of a method 900 for providing electrical connections for the area array device 104. In one embodiment, the method 900 is an automated or manual process performed by a device assembler. The device assembler may be one or more automated assembly devices, assembly workers, assembly tools, and the like. The method 900 begins, and the device assembler forms 902 the holes 212 with the conductors 302 in the circuit board 102. In one embodiment, the device assembler may form 902 the holes 212 using a mechanical drill bit, a laser drill, or the like. The device assembler may plate, solder, weld, insert, or otherwise place the conductors 302 within the holes 212.

The device assembler forms 904 the contact posts 210. In one embodiment, the contact posts 210 are formed 904 by stamping the contact posts 210 from a metal sheet, such as a copper sheet or the like. The contact posts 210, in a further embodiment, may be formed as a reel or string of multiple contact posts 210 that may be separated at various points during the method 900. In another embodiment, forming 904 the contact posts 210 may include attaching a compliant portion 406 to a spring portion 402 by welding, soldering, or the like.

The device assembler forms 906 the compliant portion 406 of each contact post 210. The device assembler, in one embodiment, forms 906 the compliant portions 406 by piercing an end of the contact posts 210 to form the eye of the needle compliant pin section 410. The forming 906 of the compliant portions 406, in a further embodiment, may include coining edges of the compliant portions 406. Coining dulls the edges and can prevent or minimize damage to the holes 212 and/or the conductors 302.

The device assembler forms 908 the spring portion 402 of each contact post 210. In one embodiment, forming 908 the spring portion 402 includes bending a cantilever beam 508, a C spring 502, or the like into each contact post 210. In a further embodiment, forming 908 the spring portion 402 includes manufacturing the radial spring 504, the fuzz button 506, or another separate compliant portion 406 for attachment to the compliant portion 406 during the step of forming 904 the contact posts 210.

The device assembler inserts 910 the compliant portion 406 of each contact post 210 into an opening of the holes 212 and the method 900 ends. In one embodiment, where the contact posts 210 are part of a reel or string of contact posts 210, the device assembler may separate the contact posts 210 from the reel or string during or prior to insertion 910 of the contact posts 210 into the holes 212.

Figure 10:
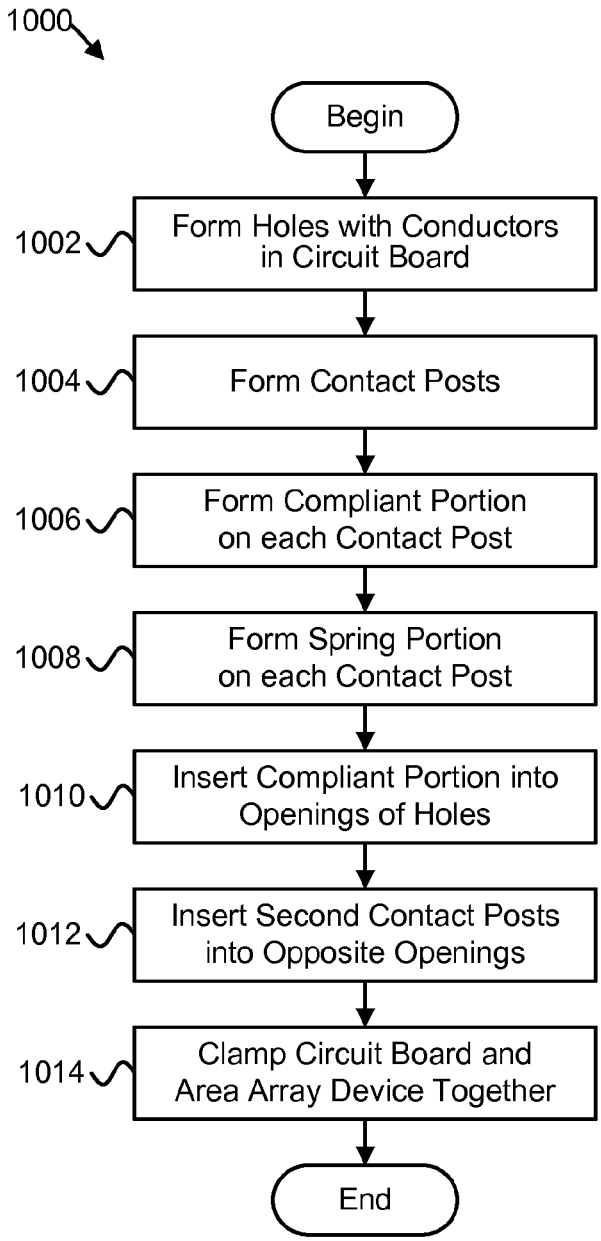
FIG. 10 is a schematic flow chart diagram illustrating another embodiment of a method for providing electrical connections for an area array device in accordance with the present invention.

FIG. 10 depicts one embodiment of a method 1000 for providing electrical connections for the area array device 104. Like the method 900, in one embodiment, the method 1000 is an automated or manual process performed by a device assembler. The method 1000 begins, and the device assembler forms 1002 the holes 212 with the conductors 302 in the circuit board 102. The device assembler forms 1004 the contact posts 210, forms 1006 the compliant portion 406 of each contact post 210, and forms 1008 the spring portion 402 of each contact post 210.

The device assembler inserts 1010 the compliant portion 406 of each contact post 210 into an opening of the holes 212, and inserts 1012 the compliant portion 406 of each of the second group of contact posts 214 into opposite openings of the holes 212. The device assembler clamps 1014 the circuit board 102, the area array device 104, and/or the second area array device 106 together to create electrical contacts between the contact posts 210, 214 and the contact pads 208, 216 using the press device 110, and the method 1000 ends.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes," "has," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An apparatus to provide electrical connections for an area array device, the apparatus comprising:

a plurality of holes disposed within a circuit board, each hole comprising a conductor within the hole and an opening on a side of the circuit board;

a plurality of electrically conductive contact posts extending from the openings of at least a portion of the plurality of holes, the plurality of contact posts disposed in a pattern corresponding to contact pads disposed on an area array device;

a second plurality of electrically conductive contact posts extending from opposite openings of at least a portion of the plurality of holes, the opposite openings disposed in an opposite side of the circuit board, the second plurality of contact posts disposed in a pattern corresponding to contact pads disposed on a second area array device electrically connecting one or more of the plurality of electrically conductive contact posts to one or more of the second plurality of electrically conductive contact posts extending from different holes of the plurality of holes, the circuit board comprising an interposer between the area array device and the second area array device;

a compliant portion of each contact post, the compliant portion inserted within one of the plurality of holes such that the conductor within the hole compresses the compliant portion to removably secure the contact post within the hole and to provide an electrical connection between the contact post and the conductor within the hole; and a spring portion of each contact post extending away from the circuit board, the spring portion compressible toward the circuit board in response to contact with a contact pad of one of the area array device and the second area array device, the spring portion providing an electrical connection between the contact post and the contact pad in response to the contact with the contact pad.

2. The apparatus of claim 1, wherein at least a portion of the conductors within the plurality of holes extend between the openings and the opposite openings.

3. The apparatus of claim 1, wherein the electrical connections of the circuit board comprise one or more circuit traces disposed on the circuit board, the one or more circuit traces in electrical communication with the conductors within one or more of the holes.

4. The apparatus of claim 3, further comprising one or more electrical devices coupled to the one or more circuit traces, the one or more electrical devices in electrical communication with the conductors within one or more of the holes through the one or more circuit traces.

5. The apparatus of claim 1, further comprising a seating portion of each contact post disposed between the compliant portion and the spring portion, the seating portion having a width greater than a diameter of a hole, the seating portion disposed against the side of the circuit board to prevent further insertion of the contact posts into the plurality of holes.

6. The apparatus of claim 1, wherein the compliant portion of each contact post comprises a cantilever beam, and the plurality of contact posts comprises at least two groups of oppositely facing contact posts to balance a force from a wiping action of the cantilever beams.

7. The apparatus of claim 1, further comprising a housing disposed adjacent to the circuit board on the side of the circuit board, the housing substantially circumscribing the plurality of contact posts, at least a part of the spring portion of each contact post extending beyond a surface of the housing that faces away from the circuit board, the surface of the housing formed to receive the area array device.

8. The apparatus of claim 7, wherein the surface of the housing is positioned to prevent the contact posts from contacting each other in response to contact with the contact pads of the area array device.

9. The apparatus of claim 1, wherein the compliant portion comprises an eye of a needle compliant pin section.

10. The apparatus of claim 1, wherein the spring portion is selected from the group consisting of a cantilever beam, a radial spring, a fuzz button, and a C spring.

11. The apparatus of claim 1, further comprising a press device that clamps the circuit board and the area array device together such that the contact pads on the area array device contact the spring portions of the plurality of contact posts, compressing the spring portions toward the circuit board.

12. A system to provide electrical connections for an area array device, the system comprising:

a circuit board;

an area array device comprising electrically conductive contact pads disposed in a pattern on the area array device;

a second area array device comprising electrically conductive contact pads disposed in a pattern on the second area array device;

a plurality of holes disposed within the circuit board, each hole comprising a conductor within the hole and an opening on a side of the circuit board;

a plurality of electrically conductive contact posts extending from the openings of at least a portion of the plurality of holes, the plurality of contact posts disposed in a pattern corresponding to the pattern of contact pads disposed on the area array device;

a second plurality of electrically conductive contact posts extending from opposite openings of at least a portion of the plurality of holes, the opposite openings disposed in an opposite side of the circuit board, the second plurality of contact posts disposed in a pattern corresponding to contact pads disposed on the second area array device electrically connecting one or more of the plurality of electrically conductive contact posts to one or more of the second plurality of electrically conductive contact posts extending from different holes of the plurality of holes, the circuit board comprising an interposer between the area array device and the second area array device;

a compliant portion of each contact post, the compliant portion inserted within one of the plurality of holes such that the conductor within the hole compresses the compliant portion to removably secure the contact post within the hole and to provide an electrical connection between the contact post and the conductor within the hole; and a spring portion of each contact post extending away from the circuit board, the spring portion compressible toward the circuit board in response to contact with a contact pad of one of the area array device and the second area array device, the spring portion providing an electrical connection between the contact post and the contact pad in response to the contact with the contact pad.

13. The system of claim 12, wherein at least a portion of the conductors within the plurality of holes extend between the openings and the opposite openings.

14. The system of claim 12, wherein the electrical connections of the circuit board comprise one or more circuit traces disposed on the circuit board, the one or more circuit traces in electrical communication with the conductors within one or more of the holes.

15. The system of claim 14, further comprising one or more electrical devices coupled to the one or more circuit traces, the one or more electrical devices in electrical communication with the conductors within one or more of the holes through the one or more circuit traces.

16. The system of claim 14, further comprising an electrical connector disposed on a perpendicular side of the circuit board, the electrical connector coupled to the one or more circuit traces, the electrical connector in electrical communication with the conductors within one or more of the holes through the one or more circuit traces.

17. The system of claim 12, further comprising a housing disposed adjacent to the circuit board on the side of the circuit board, the housing substantially circumscribing the plurality of contact posts, at least a part of the spring portion of each contact post extending beyond a surface of the housing that faces away from the circuit board, the surface of the housing formed to receive the area array device.

18. The system of claim 17, wherein the surface of the housing is positioned to prevent the contact posts from contacting each other in response to contact with the contact pads of the area array device.

19. The system of claim 17, wherein the housing comprises a plurality of slots that interface with the contact posts to removably secure the contact posts to the housing.

20. The system of claim 12, further comprising a press device that clamps the circuit board and the area array device together such that the contact pads on the area array device contact the spring portions of the plurality of contact posts, compressing the spring portions toward the circuit board.

21. An apparatus to provide electrical connections for an area array device, the apparatus comprising:

a plurality of holes disposed within a circuit board of a land grid array socket, each hole comprising a conductor within the hole and an opening on a side of the circuit board;

a plurality of electrically conductive contact posts extending from the openings of at least a portion of the plurality of holes, the plurality of contact posts disposed in a pattern corresponding to contact pads disposed on an area array device;

a second plurality of electrically conductive contact posts extending from opposite openings of at least a portion of the plurality of holes, the opposite openings disposed in an opposite side of the circuit board, the second plurality of contact posts disposed in a pattern corresponding to contact pads disposed on a second area array device electrically connecting one or more of the plurality of electrically conductive contact posts to one or more of the second plurality of electrically conductive contact posts extending from different holes of the plurality of holes, the circuit board comprising an interposer between the area array device and the second area array device;

a compliant portion of each contact post, the compliant portion comprising an eye of a needle compliant pin section, the compliant portion inserted within one of the plurality of holes such that the conductor within the hole compresses the eye of the needle to removably secure the contact post within the hole and to provide an electrical connection between the contact post and the conductor within the hole; and a spring portion of each contact post extending away from the circuit board, the spring portion comprising a cantilever beam, the cantilever beam compressible toward the circuit board in response to contact with a contact pad of the area array device, the spring portion providing an electrical connection between the spring portion and the contact pad in response to the contact with the contact pad.

22. An apparatus to provide electrical connections for an area array device, the apparatus comprising:

a plurality of holes disposed within an interposing circuit board within a land grid array socket, each hole comprising a conductor within the hole and an opening on a side of the circuit board;

a plurality of electrically conductive contact posts extending from the openings of at least a portion of the plurality of holes, the plurality of contact posts disposed in a pattern corresponding to contact pads disposed on an area array device;

a compliant portion of each contact post, the compliant portion comprising an eye of a needle compliant pin section, the compliant portion inserted within one of the plurality of holes such that the conductor within the hole compresses the eye of the needle to removably secure the contact post within the hole and to provide an electrical connection between the contact post and the conductor within the hole;

a spring portion of each contact post extending away from the circuit board, the spring portion comprising a cantilever beam, the cantilever beam compressible toward the circuit board in response to contact with a contact pad of the area array device, the spring portion providing an electrical connection between the spring portion and the contact pad in response to the contact with the contact pad;

a seating portion of each contact post disposed between the compliant portion and the spring portion, the seating portion having a width greater than a diameter of a hole, the seating portion disposed against the side of the circuit board to prevent further insertion of the contact posts into the plurality of holes;

a housing disposed adjacent to the circuit board on the side of the circuit board, the housing substantially circumscribing the plurality of contact posts, at least a part of the spring portion of each contact post extending beyond a surface of the housing that faces away from the circuit board, the surface of the housing formed to receive the area array device, the surface of the housing positioned to prevent the contact posts from contacting each other in response to contact with the contact pads of the area array device, the housing comprising a plurality of slots that interface with the contact posts to removably secure the contact posts to the housing;

a second plurality of electrically conductive contact posts extending from opposite openings of at least a portion of the plurality of holes, the opposite openings disposed in an opposite side of the circuit board, at least a portion of the conductors within the holes extending between the openings and the opposite openings, the second plurality of contact posts disposed in a pattern corresponding to contact pads disposed on a second area array device electrically connecting one or more of the plurality of electrically conductive contact posts to one or more of the second plurality of electrically conductive contact posts extending from different holes of the plurality of holes, the circuit board comprising an interposer between the area array device and the second area array device;

one or more circuit traces disposed on the circuit board, the one or more circuit traces in electrical communication with the conductors within one or more of the holes;

one or more electrical devices coupled to the one or more circuit traces, the one or more electrical devices in electrical communication with the conductors within one or more of the holes through the one or more circuit traces; and an electrical connector disposed on a perpendicular side of the circuit board, the electrical connector coupled to the one or more circuit traces, the electrical connector in electrical communication with the conductors within one or more of the holes through the one or more circuit traces.

* * * * *